United States Patent [19]

Williams

[11] 4,200,241

[45] Apr. 29, 1980

[54] PULVERIZING AND CLASSIFYING APPARATUS WITH CONTAMINANT TAKE-OUT

[75] Inventor: Norman E. Williams, Coon Rapids, Minn.

[73] Assignee: Bepex Corporation, Santa Rosa, Calif.

[21] Appl. No.: 948,491

[22] Filed: Oct. 4, 1978

Related U.S. Application Data

[63] Continuation of Ser. No. 822,721, Aug. 8, 1977, abandoned.

[51] Int. Cl.[2] ..... B02C 13/08; B02C 23/12; B02C 23/32

[52] U.S. Cl. ..... 241/52; 241/79; 241/80

[58] Field of Search ..... 241/5, 40, 52, 79, 79.1, 241/80, 275

[56] References Cited

U.S. PATENT DOCUMENTS

| | | | |
|---|---|---|---|
| 910,196 | 1/1909 | Hess | 241/80 |
| 2,939,638 | 6/1960 | Haigh et al. | 241/52 |
| 3,038,672 | 6/1962 | Langsetmo et al. | 241/52 X |
| 3,688,991 | 9/1972 | Andrews | 241/5 |

*Primary Examiner*—Richard B. Lazarus
*Attorney, Agent, or Firm*—McDougall, Hersh & Scott

[57] ABSTRACT

A horizontal axis pulverizing and classifying apparatus fitted with special means for removing contaminants, such as abrasive particles, which reduce the capacity and efficiency of such apparatus. The contaminant take-out device is a porous tubular duct communicating with the classification zone of the apparatus through the housing wall. The porous tubular duct is surrounded by a non-porous tubular casing forming an annulus connected to a source of gas under pressure by means of which the quantity of contaminant tailings is removed by varying the amount and pressure of gas introduced. The apparatus may also include a plurality of gas flow apertures surrounding the classification zone and directed generally radially inward, and means for selectively and variably introducing gas to those apertures, for providing improved control over the contaminant take-out device.

5 Claims, 4 Drawing Figures

30
46
16
42
43
44
10
43
24
32
2
29
2
25
31
28
46
44
11

20
16
15
22
12
10
30
17
18
19
23
21
14
32
24
7
7
29
42
28
26
13
31
27
25

PULVERIZING AND CLASSIFYING APPARATUS WITH CONTAMINANT TAKE-OUT

This is a continuation of application Ser. No. 822,721, filed Aug. 8, 1977 now abandoned.

BACKGROUND OF THE INVENTION

This invention is directed to pulverizing and classifying apparatus of the type in which material to be reduced in size is introduced into one end of a cylindrical housing or casing and, by action of the horizontal axis pulverizing and classifying rotors therein, is progressively reduced in size. In the classifying zone of the apparatus, particles of the desired size and finer are removed and coarse or partially ground particles are recycled for further reduction. The pulverizer-classifier of U.S. Pat. No. 3,038,672 is exemplary of such apparatus.

It is well known that a small percentage of hard abrasive contaminant, for example ½ to 1 percent of a metallic oxide (for example, alumina and magnesia scale) in material being ground, can greatly reduce the capacity of the pulverizing apparatus. Such contaminants also make it more difficult to meet fine grinding specifications where all of the fine particles are desired to be of as uniform a size as possible. This is especially true if the contaminant is somewhat harder than the product being ground. In some cases, the product is not contaminated by foreign substances but in its natural state has a small percentage of extra-hard particles in it. In either case, since these particles are harder to reduce in size, they will tend to continuously recycle in the tailings return. As more and more of these harder over-size particles are recycled, the capacity and efficiency of the apparatus is reduced. Any portion of these particles which escape with the fine product may tend to be coarser than the rest of the product and make it difficult to hold fineness specifications. Generally these harder particles are more abrasive and in many cases the majority of the internal wear of the apparatus is caused by this small fraction of extra hard material. The contaminants may also be particles which are darker or otherwise different in color from the desired product such that it is preferable that they be removed. The present invention is directed toward alleviation of these problems.

SUMMARY OF THE INVENTION

Broadly stated, the invention is directed to an improvement in a pulverizing and classifying apparatus having a cylindrical housing with inlet and discharge means adjacent its opposite ends, rotary horizontal axis pulverizing means within the housing adjacent the inlet end and coaxial rotary classifying means within the housing adjacent the discharge end, and port means through the housing adjacent the classifying end for withdrawing tailings for recycling. The improvement resides in a contaminant take-out device located on the housing adjacent to the classifying zone and spaced peripherally substantially from the tailings port. The take-out device includes a porous tubular duct, one end of which communicates with an aperture in the housing wall, a tubular housing surrounding the porous duct, and a gas inlet in the tubular housing communicating with an annulus between the tubular housing and porous duct.

As used herein, the term "contaminant" refers to particles which are coarser or harder than the desired product or different in color from the desired product. Such particles may be abrasive particles present as foreign contaminants or may be merely the natural state of a portion of the material to be pulverized. The term "contaminant" includes but is not limited to harsh, rough refractory type materials.

BRIEF DESCRIPTION OF THE DRAWINGS

The invention is illustrated by the accompanying drawings in which corresponding parts are identified by the same numerals and in which.

DETAILED DESCRIPTION OF THE PREFERRED EMBODIMENT

Figure 1:
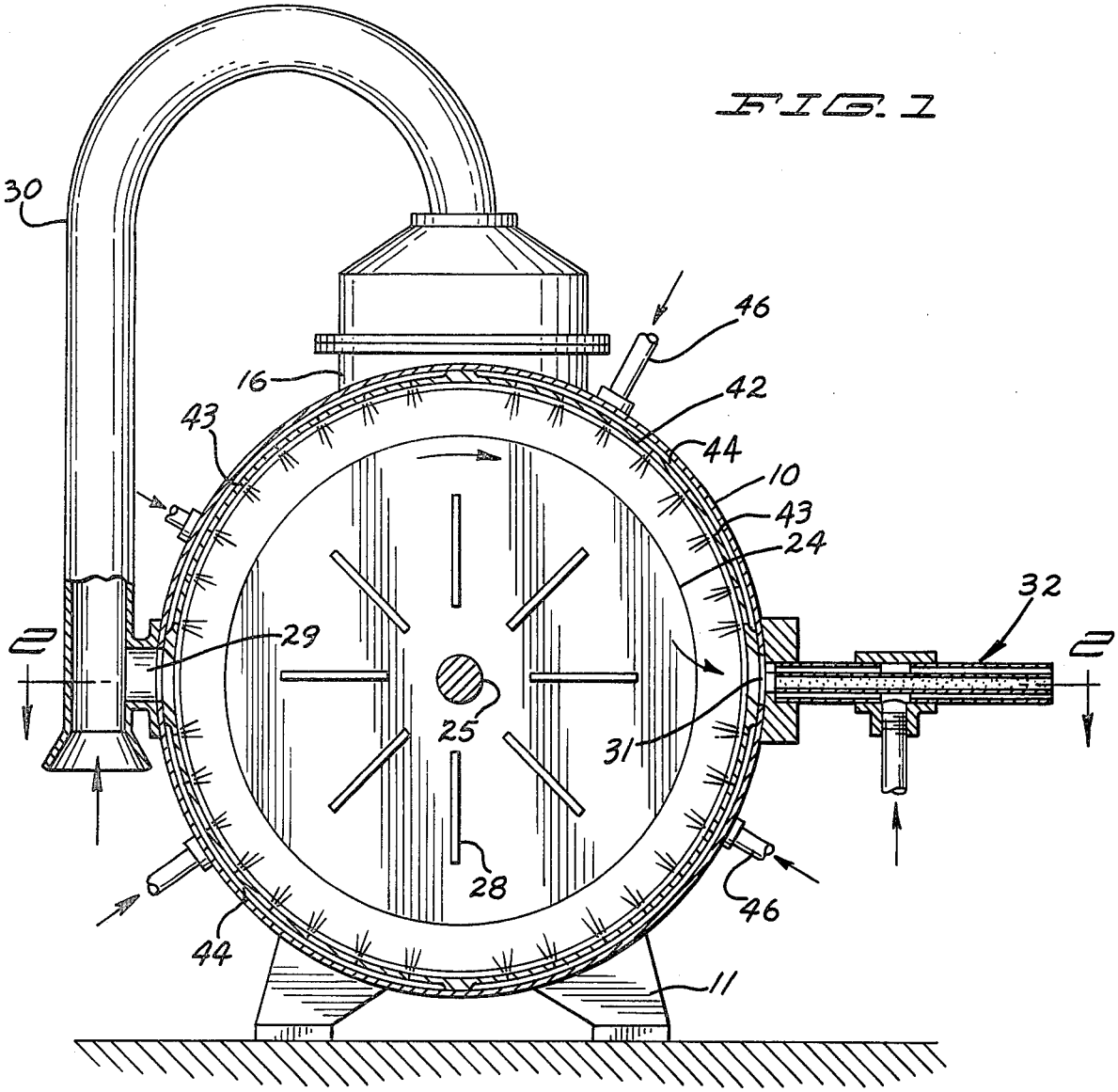
FIG. 1 is an elevation, partly in section, of a pulverizing and classifying apparatus embodying the invention.
Figure 2:
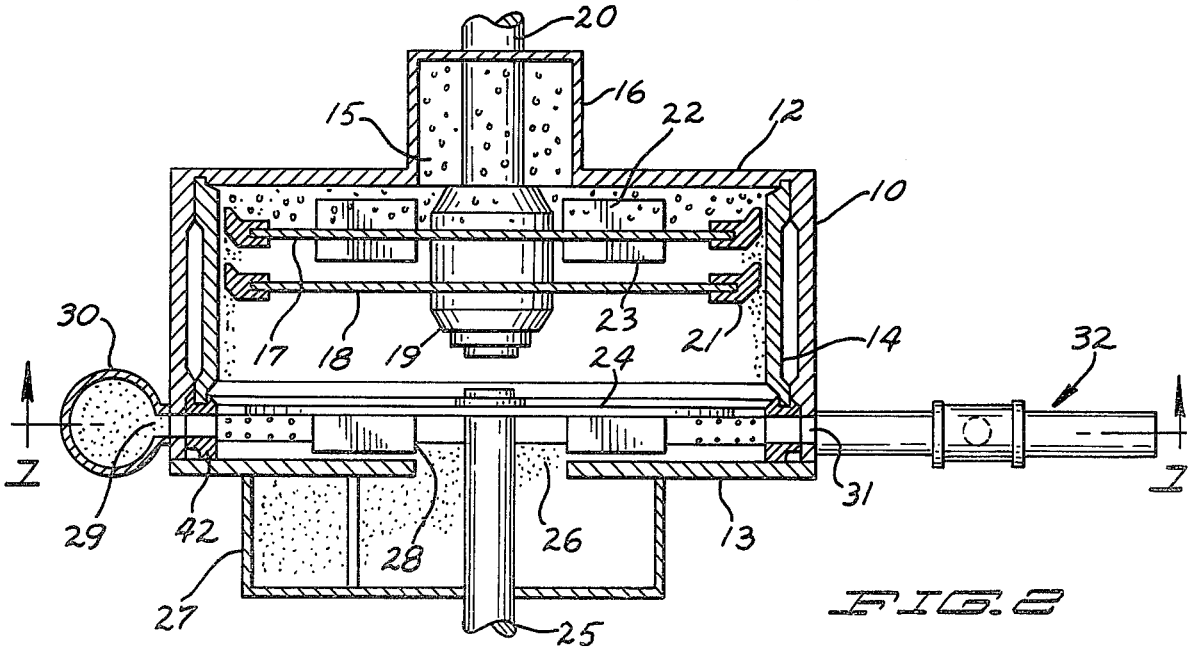
FIG. 2 is a horizontal section on line 2—2 of FIG. 1 and in the direction of the arrows.

Referring to the drawings, and particularly FIGS. 1 and 2, the apparatus of this invention comprises a cylindrical housing 10 supported for example on feet or legs 11. The housing has end walls 12 and 13 and, as shown, preferably has a removable liner 14 which is replaceable when worn. End wall 12 has an inlet opening 15 located in the central portion thereof. Inlet 15 communicates with a hopper 16 through which material to be ground is fed and through which tailings are recycled for further reduction.

A pulverizing rotor is mounted for rotation within the housing adjacent the feed inlet. That rotor comprises one or more discs or circular beater plates 17 and 18 mounted on hub 19 on shaft 20. Each beater plate carries a plurality of spaced beaters 21 mounted on the peripheral edges thereof. Beater plate 17 closest to the feed inlet carries a plurality of radiating primary beater vanes or angles 22 spaced radially inwardly from the beaters 21 and mounted on the feed inlet side of the plate. The edges of beater vanes 22 are closely spaced from end wall 12 and in cooperation therewith perform a primary size reduction of the material to be ground. The opposite side of beater plate 17 carries a plurality of similar secondary beater vanes or angles 23 which serve to balance the beater plate and to assist in performing the pulverizing function in conjunction with the next adjacent beater plate 18.

A classifier disc 24 is mounted on coaxial shaft 25 which extends through an outlet or discharge aperture 26 in end wall 13. Aperture 26 communicates directly with a scroll housing 27 for removal of the desired pulverized product. A plurality of radial classifying vanes 28 are mounted on the discharge side of disc 24.

Housing 10 is provided with a tailings port or aperture 29 adjacent the periphery of classifier disc 24 in the classifying zone for withdrawal of tailings, those particles not reduced to the desired particle size. These tailings are withdrawn through aperture 29 and may be recycled through duct 30 for further pulverizing.

The basic structure of the apparatus described to this point and its basic mode of operation in reducing material to be ground and in classifying the reduced particles are generally the same as those of the aforesaid U.S. Pat. No. 3,038,672, which is incorporated herein by reference.

Figure 3:
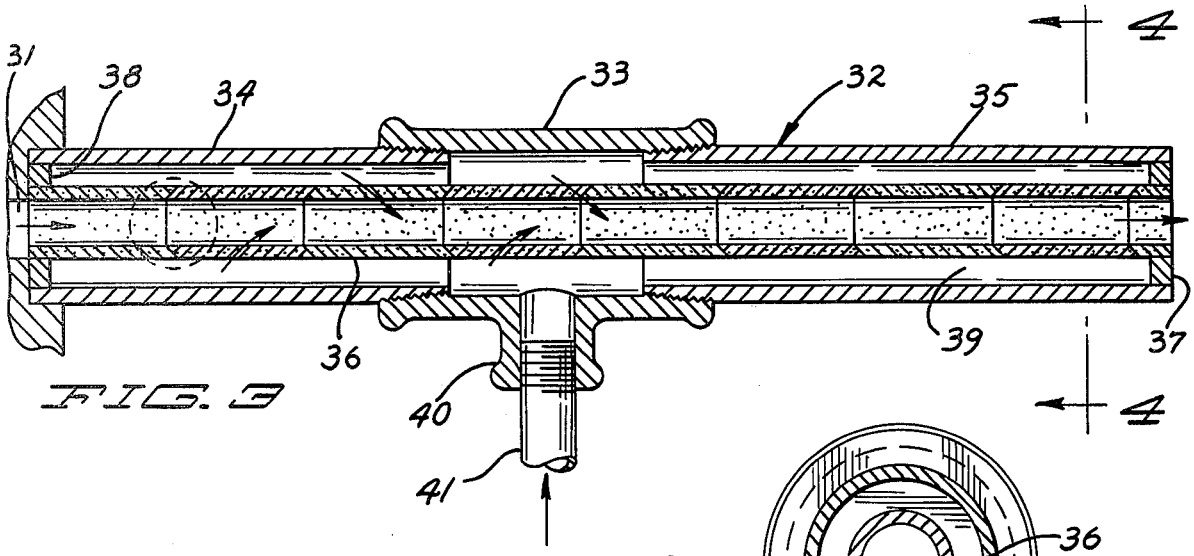
FIG. 3 is a sectional view showing the abrasive particle take-out device in greater detail.
Figure 4:
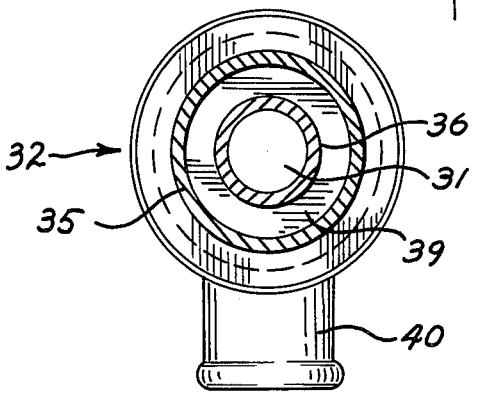
FIG. 4 is a section on the line 4—4 of FIG. 3 and in the direction of the arrows.

Turning now to the improvement of the present invention, the housing 10 is provided with a contaminant take-out port or aperture 31 located adjacent to the periphery of classifier disc 24 and spaced peripherally around the housing from the tailings aperture, preferably 180° apart, diametrically opposed, as shown. A contaminant take-out device, indicated generally at 32, is secured to the outer housing wall to project substantially radially outwardly therefrom and in direct communication with aperture 31. As best seen in FIGS. 3 and 4, the take-out device 32 comprises a T-fitting 33 in whose opposite ends are fitted pipe segments 34 and 35 which together form a tubular housing. An inner concentric porous tube 36 is positioned within the tubular housing held by annular spacers 37 and 38 at opposite ends of the housing. The inner porous tube is made for example from porous sintered metal segments, porous sponge metal or synthetic resinous plastic sponge formed into a tube, wire or plastic screening wound on a mandrel into tube form, perforated metal or plastic tubing, or the like.

The diameter of the inner porous tube is small in relation to the outer tubular housing to form an annulus 39. The side port 40 to T-fitting 33 is connected by means of pipe or tube 41 to a source of gas, such as air, under pressure. By this means, a jacket of gas is formed around the full length of the inner porous tube 36. Control of the quantity of contaminants (for example, alumina and magnesia scale) removed can be accomplished by varying the diameter of the inner porous tube and by varying the quantity and pressure of air passed through the porous tube from the annulus. Accordingly, unless a particular pulverizing and classifying apparatus is to be used for grinding one material only, it is preferable that several porous tubes 36 of varying diameter and corresponding spacers be provided.

The exterior end of porous tube 36 may be connected to a cyclone or similar separator for collecting the contaminant particles taken out. Depending upon the particular material being pulverized, the taken-out portion may be marketable as a lower grade of the desired reduced product, or it may simply be discarded.

The apparatus desirably also includes a gas flow control ring, indicated generally at 42, which is disposed around the inside periphery of housing 10 in the classification zone adjacent to the peripheral edge of classifier disc 24. The gas flow ring permits better control over particles withdrawn through the take-out device. It is shown and described in greater detail in my copending application Ser. No. 822,725 of even filing date herewith. Generally speaking, gas flow ring 42 is provided with a narrow row of a plurality of closely spaced gas flow apertures 43. The outer perimeter of ring 42 is provided with a groove or channel 44 which serves as a gas distribution duct to the apertures which extend through the ring in direct gas flow communication with the channel. Ring 42 is provided with suitable apertures or ports so located as to be adjacent to tailings port 29 and abrasives take-out port 31. Preferably the gas distribution channels are provided as a series of a plurality of spaced apart segments disposed end to end around the outer periphery of the ring 42. A plurality of gas inlet apertures are provided in housing 10 and fitted with connections 46 to suitable sources of gas under pressure. Desirably the gas distribution duct has four segments, each supplying air to a quadrant for variable control of gas pressure applied to any or all of the quadrants.

In a typical operation of an apparatus of the type described, the material to be ground consists of particles of varying sizes and weights. The forces applied to the material in the apparatus are known to stratify the material—that is, larger and heavier pieces will tend to congregate adjacent the inner wall while the lighter pieces will be spaced inwardly. Such conditions, for example, will characterize the operation of the apparatus discused in the aforementioned U.S. Pat. No. 3,038,672.

As the material progresses toward the discharge aperture 26, it encounters the apertures 29 and 31 defined by the ring 42. Since the material is stratified, amounts of the heavier and larger particles will pass through these apertures. The proportion of material passing through a particular aperture will depend upon the size of the aperture. As explained in the aforementioned copending application Ser. No. 822,725, additional control of the material passing through the apertures can be accomplished through utilization of the gas streams exiting from the spaced positions of ring 42.

The basic pulverizing and classifying apparatus modified in accordance with this invention was tested under a variety of operating conditions. The test material was limestone known to contain about 1 to 2 percent of alumina and magnesia scale picked up in the limestone from kiln driers. Porous take-out tubes were used in three sizes, $\frac{1}{4}$ inch, $\frac{3}{8}$ inch and $\frac{1}{2}$ inch inside diameter and approximately 10 inches in length. Pressure in the take-out device varied from 0 to 60 pounds per square inch.

From the tests, it was determined that grinding the product to a finer size can be accomplished more easily when the take-out device 32 is used as compared to when it is not used. Over long periods of time, this means increased capacity and reduced wear. Use of the take-out device results in improved product color. The reduced limestone product is very white whereas the material removed by the take-out device is grey in color. When the take-out device is not used, the product is less white. Higher air pressure up to 60 pounds in the upper right hand quadrant of the gas flow ring results in reduced take-out of contaminant particles and lower pressure down to 20 pounds results in increased take-out Take-out also occurs when the apparatus is not fitted with a gas flow ring or when it is not used. Take-out increases with increasing size of the porous tube and increasing pressure on the annulus surrounding that tube.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention which an exclusive property or privilege is claimed are defined as follows:

1. In a pulverizing and classifying apparatus comprising a cylindrical housing having inlet and discharge means adjacent opposite ends, rotary horizontal axis pulverizing means within the housing adjacent the inlet end and coaxial rotary classifying means within the housing adjacent the discharge end, and port means adjacent said classifying means for withdrawing tailings for recycling, the improvement comprising an aperture in said housing wall independent of said port means, said aperture being located adjacent said classifying means and spaced-apart from said port means, and a contaminant take-out device mounted on said housing and communicating with said aperture, said device comprising:

(1) a gas-transmitting tubular duct, one end of which communicates with said aperture in the housing wall, said duct receiving a portion of said tailings, (2) a housing surrounding said duct, and (3) a gas inlet for said housing, said gas inlet providing gas under pressure around said duct whereby the gas is transmitting through the duct into contact with said portion of said tailings for thereby controlling the tailings received by said duct.

2. An apparatus according to claim 1 further characterized in that said tailings port and said aperture communicating with said duct are spaced peripherally about 180°.

3. An apparatus according to claim 1 further characterized in that said duct is composed of a material selected from the group consisting of sintered metal, porous metal sponge, tubular screen, porous synthetic resinous plastic sponge, perforated metal tubing and perforated plastic tubing.

4. An apparatus according to claim 1 further characterized in that said housing comprises a central T-fitting and a pair of coaxial non-porous tubular segments fitted therein.

5. An apparatus according to claim 1 further characterized in that said duct is coaxial with said aperture in the housing wall.

* * * * *